US006383032B1

(12) United States Patent
Gerberding

(10) Patent No.: US 6,383,032 B1
(45) Date of Patent: May 7, 2002

(54) ELECTRICAL CONNECTOR AND METHOD OF MANUFACTURE

(75) Inventor: Wolfgang Gerberding, Hessisch-Oldendorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 09/611,078

(22) Filed: Jul. 6, 2000

(30) Foreign Application Priority Data

Jul. 6, 1999 (DE) ..... 199 32 243

(51) Int. Cl.[7] ..... H01R 13/69
(52) U.S. Cl. ..... 439/681
(58) Field of Search ..... 439/186, 181, 439/680, 368, 355, 357, 358, 681, 544, 545, 541, 352, 370, 717

(56) References Cited

U.S. PATENT DOCUMENTS 4,448,467 A * 5/1984 Weidler ..... 439/80
6,165,024 A * 12/2000 Ko ..... 439/680

FOREIGN PATENT DOCUMENTS

| | | |
|---|---|---|
| DE | 34 40 043 A1 | 5/1986 |
| DE | 41 10 320 C1 | 7/1992 |
| DE | 195 00 156 A1 | 7/1995 |
| EP | 0 471 943 B1 | 1/1997 |

* cited by examiner

*Primary Examiner*—Gary Paumen
*Assistant Examiner*—Larisa Tsukerman
(74) *Attorney, Agent, or Firm*—Salter & Michaelson

(57) ABSTRACT

An electrical connector is provided including a plug unit and a socket unit, both of which have one anti-shock sleeve for each pole, such that when the connector is closed the anti-shock sleeves of the socket unit are pushed into appropriately shaped uptake chambers of the anti-shock sleeves of the socket unit. To improve the stability of the closed connector, configure the anti-shock sleeves of the plug unit are configured with a multi-chamber cross section profile, preferably a two-chamber cross section profile. As a result, the second uptake chambers of the two-chamber anti-shock sleeves of the plug unit may provide additional variable coding of the connector.

4 Claims, 2 Drawing Sheets

ELECTRICAL CONNECTOR AND METHOD OF MANUFACTURE

BACKGROUND

1. Field of the Invention

The present invention is related to an electrical connector.

2. Related Art

EP 0 471,943 B1 discloses an electrical connector that includes a plug unit with an insulator housing and a socket unit with an insulator housing, both of which have a molded anti-shock sleeve for each pole, such that when the connector is closed the anti-shock sleeves that surround the contacts of the socket unit can be inserted into the receiving chambers of the anti-shock sleeves that surround the pins of the plug unit, while the cross section profiles of the uptake chambers of the anti-shock sleeves of the plug unit each correspond in shape and are substantially fitted to the outer cross section profile of the corresponding anti-shock sleeves of the socket contacts (fixed coding).

Such connectors have many uses in instrument and installation engineering. However, such connectors have the systematic disadvantage that the anti-shock sleeves, which can be inserted one into the other with identical shape for coding purposes, nevertheless require a sufficiently large play in their accuracy of fit so that in practical terms the anti-shock sleeves can be joined together and separated again with the least possible insertion force. The aforesaid play in the accuracy of fit of the anti-shock sleeves of a connector means that the connectors are not very stable in the closed condition, especially since the relatively long anti-shock sleeves of the plug unit, which surround the particular plug pin at a distance (cross section of the uptake chambers), are relatively unstable because of their tubular cross section profile and usually slight wall thickness. In robust use of such connectors, for example, for heating purposes, the instability can lead to contact problems.

One object of the invention is to develop a more stable configuration of such connectors, without increasing the insertion forces when closing and opening the connector and without limiting the coding possibilities of the anti-shock sleeves that fit together.

SUMMARY

One embodiment of the invention is directed to an electrical connector that includes a plug unit. The anti-shock sleeves of the plug unit each have a multi-chamber cross section profile. In some embodiment, the cross-section profile is a two-chamber cross section profile, which is formed from a first uptake chamber, surrounding the plug pin, and a second uptake chamber, such that the second uptake chamber runs parallel to the first uptake chamber and is shaped as a single piece with it and is separated from the first uptake chamber by an insulator partition.

The two-chamber cross-section profile of the anti-shock sleeves of the plug unit improves the shape stability (stiffness) of the relatively long anti-shock sleeves very substantially, while the material required for the insulator walls of the second uptake chamber increases only slightly, since the two-chamber anti-shock sleeves gain their improved shape stability primarily from the multi-chamber cross-section profile and not from increasing the wall thickness of the uptake chambers.

By inserting the anti-shock sleeves of the socket contacts (which are more stable by their very nature, since they enclose the socket contacts more tightly and with thicker walls, in comparison to that disclosed in EP 0 471,943 B1) into the anti-shock sleeves of the plug pins (which are configured as two-chamber anti-shock sleeves in the present), the connector achieves overall a good stability of use in the closed condition, even when the second uptake chamber of the anti-shock sleeves of the plug unit remains unused.

However, a further development of the invention envisions a meaningful use for the second uptake chamber of the two-chamber anti-shock sleeves.

In another embodiment, the second uptake chamber can accommodate an insert peg, which is molded on the insulator housing of the socket unit and which, when the connector is closed, engages by precise shape and fit with the corresponding second uptake chamber of the two-chamber cross section profile of the anti-shock sleeves of the plug unit. Insert pegs of this kind, which are made dimensionally stable with the insulator housing of the socket unit, provide an additional stabilization of the connector in the closed condition, so that it is suitable for especially robust practical applications.

In another embodiment, the second uptake chamber of the two-chamber antishock sleeves has insert pegs molded on the insulator housing of the socket unit. The insert pegs have predetermined breaking notches near the insulator housing, so that they can be optionally separated (e.g., broken off) for coding purposes and can be inserted in the corresponding uptake chambers of the two-chamber anti-shock sleeves of the plug unit. In this way, a connector has a further variable coding possibility in addition to its fixed coding (which is permanently provided by the manufacturer through the respective shape identity of the anti-shock sleeves fitting together).

In another embodiment, it is very advantageous to have the two-chamber cross-section profile of the anti-shock sleeves of the plug unit configured on two levels, so that all of the second uptake chambers are situated on an upper level and all the first uptake chambers are arranged on a lower level. The aforesaid fixed coding is realized in that the manufacturer provides molded projections and recesses in the side walls of the first uptake chambers, which extend only in the direction of the lower level. In this way, the lower level is optimally utilized, and a relatively flat overall construction of the connector is achieved despite the arrangement of the second uptake chambers on an upper level.

In another embodiment, where the second uptake chambers of the two-chamber anti-shock sleeves of the plug unit are positioned according to the previous embodiment, an optimal space utilization is provided in that the width of the second uptake chambers extending in the direction of the upper level is dimensioned such that a free space (open space) is formed on the upper level between the second uptake chambers of neighboring anti-shock sleeves, and in the free space are positioned the structural elements of an interlock device, which joins together the halves of the connector (plug unit and socket unit) in the closed state.

In another embodiment, the structural elements of an interlock device can be arranged almost completely embedded in the free space, so that they project little if at all from the outer contours of the connector halves. This greatly protects the interlock device from an unintentional loosening.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

Figure 1:
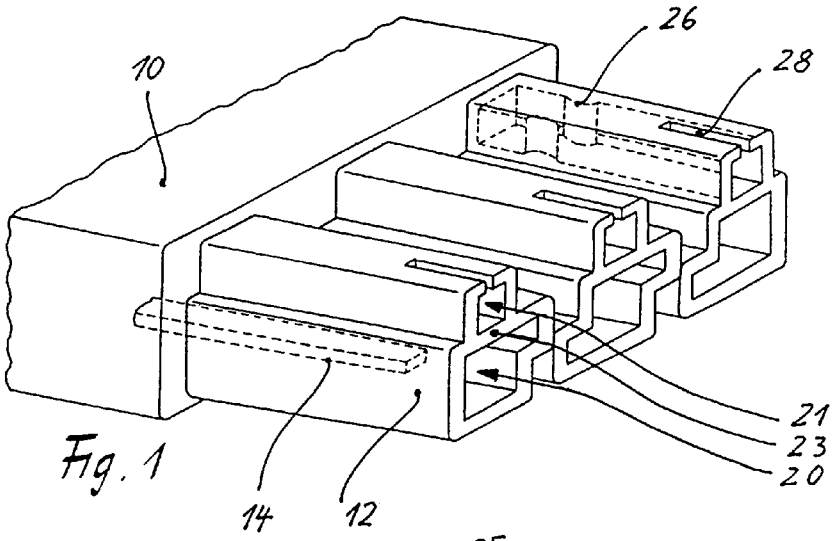
FIG. 1 is a schematic illustration of the plug unit of one embodiment of a connector.
Figure 2:
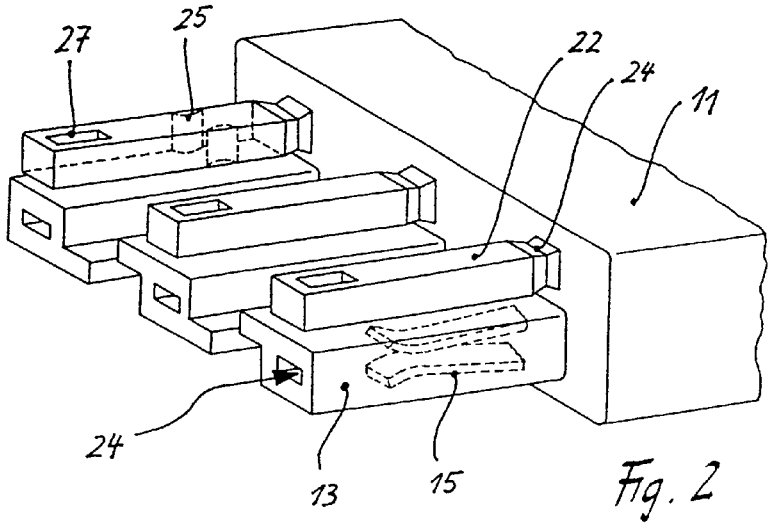
FIG. 2 is schematic illustration of the socket unit of a connector according to the embodiment of FIG. 1.

FIGS. 1 and 2 show the plug unit with the insulator housing 10 (see FIG. 1) and the socket unit with the insulator housing 11 (see FIG. 2). For each pole, one anti-shock sleeve 12 for the plug pin 14 and one anti-shock sleeve 13 for the socket contact 15 are molded on the insulator housing.

The anti-shock sleeve 12 of the plug unit is configured as a two-chamber anti-shock sleeve with a two-chamber cross section profile, formed from the first uptake chamber 20, which surrounds the plug pin 14 at a distance, and a second uptake chamber 21, such that the second uptake chamber 21 runs parallel to the first uptake chamber 20 and is fashioned as a single piece with it and is separated from the first uptake chamber by an insulator partition 23.

The socket unit of the connector shown in FIG. 2 has an anti-shock sleeve 13 for each pole, which surrounds the socket contact 15 quite closely in familiar fashion and has at its front end a continuous opening 24, through which the plug pin 14 can be inserted into the socket contact 15 as soon as the anti-shock sleeve 13 of the socket contact is pushed into the first uptake chamber 20 of the anti-shock sleeve of the plug unit.

Figure 3:
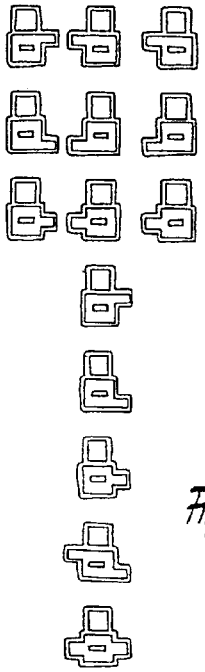
FIG. 3 is a schematic illustration of the various coding possibilities of the connectors of FIGS. 1 and 2.

A fixed coding is provided at the factory for the fitting together of the anti-shock sleeves when the connector is plugged in, due to the fact that the cross section profile of the first uptake chamber 20 of the plug unit must correspond with exact shape and fit to the outer cross section profile of the respective anti-shock sleeves 13 of the socket unit. FIG. 3 illustrates (in top view at the front end of the anti-shock sleeves of the plug unit) various possibilities of coding of a three-pole connector, as is shown in FIGS. 1 and 2 as an example.

Above the anti-shock sleeves 13 of the socket unit represented in FIG. 2 there are insert pegs 22 molded on its insulator housing 11 which, when the connector is plugged together, engage with exact shape and fit in the corresponding second uptake chambers 21 of the two-chamber cross section profile of the anti-shock sleeves of the plug unit shown in FIG. 1.

These insert pegs have predetermined breaking notches 24 and can be separated from the insulator housing of the socket unit. In the non-separated condition, they are joined in dimensionally stable manner with the socket unit and provide an additional stability to the connector in the closed state since, as mentioned above, they engage with the two-chamber cross section profile of the plug unit. If, however, at the choice of the user, the insert pegs are separated from the socket unit at their predetermined breaking notch 24 and inserted and locked in the second uptake chamber 21 of the two-chamber cross section profile of the anti-shock sleeves of the plug unit, this produces a variable coding possibility, which can be carried out at the choice of the user, in addition to the permanent coding dictated by the manufacturer.

In order for the separated insert pegs to be able to lock in captive manner in the respective second uptake chamber of the two-chamber cross section profile of the anti-shock sleeves of the plug unit, the insert pegs 22 have transverse valleys 25 at the side (see FIG. 2) and after being separated from the socket unit they are inserted by their foot end first into the second uptake chambers, whereupon their transverse valleys 25 engage with transverse bulges 26 at the side, which are formed in the respective second uptake chambers (see FIG. 1).

The depression 27 present at the head end of the insert pegs for engagement with a screwdriver blade (see FIG. 2) lies, in the inserted and interlocked condition of the peg, directly underneath the working slot 28 of the second uptake chamber (see FIG. 1), so that the insert peg can also be worked out again from the second uptake chamber by means of a screwdriver blade, if this should prove necessary or desirable.

FIG. 1 clearly shows that, in the depicted embodiment example, the twochamber cross section profile of the anti-shock sleeves is constructed on two levels. On the upper level lie all of the second uptake chambers 21, and on the lower level lie all of the first uptake chambers 20, while the permanent codings in the cross section profile of the first uptake chambers are basically situated in the side walls of the first uptake chambers and extend in the direction of the lower level, so that the upper level remains free of these codings (cf. FIG. 3 and FIG. 1).

Figure 4:
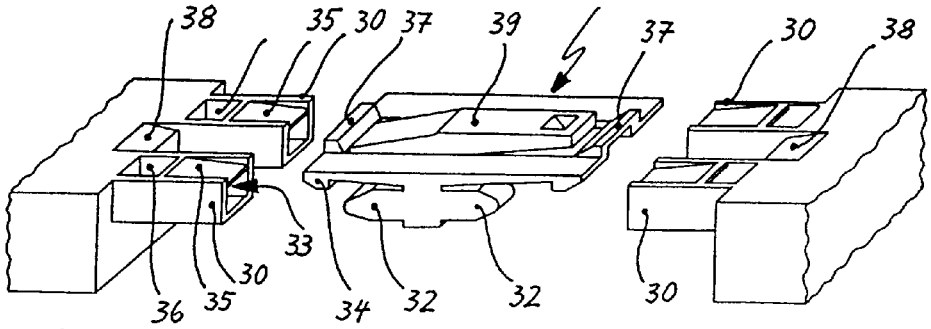
FIG. 4 is a schematic illustration of the structural elements of an interlock device according to the invention.

This makes it possible to create free spaces on the upper level between the respective second uptake chambers 21 of neighboring anti-shock sleeves, in which the structural elements of an interlock device can be positioned, which locks together the halves of the connector (plug unit and socket unit) in the closed condition. FIG. 4 shows one such interlock device.

The interlock device according to FIG. 4 has two detent hook seats 30 molded on each half of the connector, all of them being identical in construction and interacting with a detent hook connection piece 31. The detent hook connection piece has two holding pegs 32 on each side, which can be inserted into the lengthwise shafts 33 of the detent hook seats. When inserted, the particular detent hook 34 slides across the stopping bevel 35 into the detent cavity 36.

In order to loosen the detent hook 34 from the detent cavity 36, the bridge 37 between the two neighboring detent hooks has a screwdriver blade driven underneath it. For this, the screwdriver blade is pushed across the bevel 38 underneath the bridge 37. This type of loosening of the detent hooks from their cavity can be performed both on the left and right side of the depicted detent hook connection piece.

A second type of loosening of the detent hook represented on the left side of FIG. 4 is possible by means of the rocking lever 39, whose right-hand end can be pressed down with a tool or the like, so that its left-hand end lifts the bridge 37 between the neighboring detent hooks on the left side.

The detent hook connection piece 31 can be interlocked with the detent hook seats of the left half of the connector or with the detent hook seats of the right half of the connector even before the connector is closed, thus forming an easily manipulated assembly unit with the particular half of the connector.

The detent hook connection piece can be interlocked with the detent seats 30 of the connector halves in the arrangement shown by FIG. 4, but it can also be rotated 180° and interlocked with the detent seats of the connector halves, depending on the manipulation advantages to the user if the rocking lever 39 is activated close to one or the other half of the connector.

Figure 5:
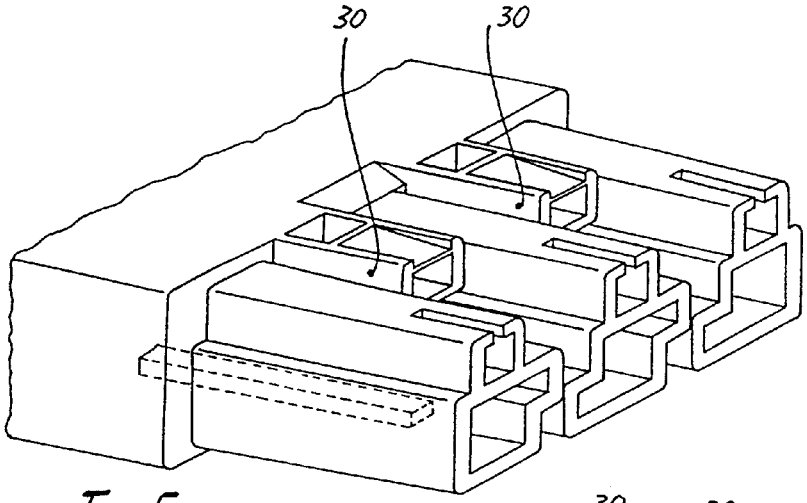
FIG. 5 is a schematic illustration of the plug unit of FIG. 1 with the interlock device of FIG. 4.
Figure 6:
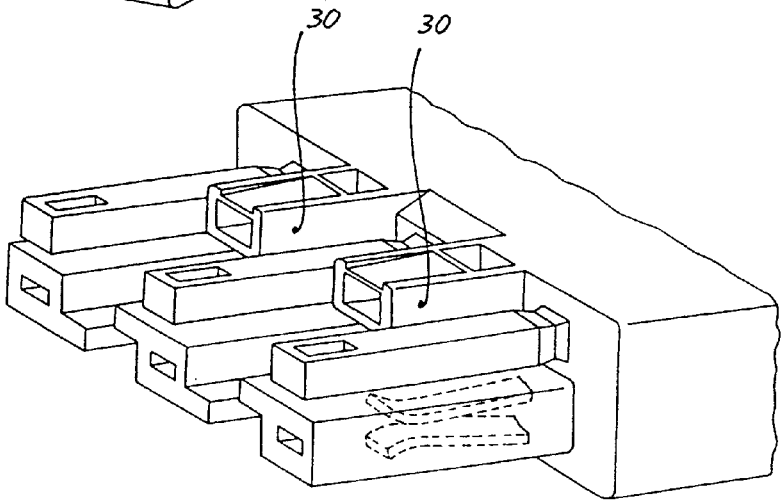
FIG. 6 is a schematic illustration of the socket unit of FIG. 2 with the interlock device of FIG. 4.

FIGS. 5 and 6 show how the detent hook seats 30 can be integrated in the free spaces of the connector halves. The connector halves themselves have already been explained in detail by means of FIGS. 1 and 2, so the reader may refer to them.

What is claimed is:

1. An electrical connector assembly, comprising:

a plug unit with a first insulator housing and a socket unit with a second insulator housing, the plug unit and the socket unit each having more than one electrical terminal, each of the electrical terminals being surrounded by integral anti-shock sleeves projecting from each of the first and second insulator housings;

the first insulator housing of the plug unit being a receptacle housing and having plug pin terminals inside the anti-shock sleeves and the second insulator housing of the socket unit being a plug housing and having socket terminals inside the anti-shock sleeves, the cross section profiles of the anti-shock sleeves of the plug unit corresponding in size and shape to the outer cross section profiles of the anti-shock sleeves of the socket unit, such that the anti-shock sleeves of the socket unit can be pushed into the anti-shock sleeves of the plug unit;

wherein the anti-shock sleeves of the plug unit each have a two-chamber cross section profile including a first chamber surrounding each plug pin terminal and being the receiving chamber for the anti-shock sleeve of the socket unit and a second chamber devoid of electrical terminals, the second chamber being parallel to and integrally formed with the first chamber and being separated from the first chamber by an insulator partition.

2. The electrical connector assembly of claim 1, wherein the two-chamber cross section profiles of the anti-shock sleeves of the plug unit are constructed on two levels, such that all of the second chambers are situated on the same upper level and all of the first chambers are arranged on a lower level;

wherein the width of the second chambers extending in the direction of the upper level is such that free spaces are formed on the upper level between neighboring anti-shock sleeves; and an interlock device or elements of such an interlock device for locking together the plug unit and the socket unit in the closed condition are positioned in said free spaces so that the interlock device projects little if at all from the outer contours of the connector assembly.

3. The electrical connector assembly of claim 1, further comprising at least one insert peg projecting from the second, plug insulator housing which engages with the shape and fits in the second chamber of the anti-shock sleeves of the plug unit when the connector is closed.

4. The electrical connector of claim 3, wherein each of the at least one insert peg has predetermined breaking notches near the second, plug insulator housing; and the insert pegs have projecting parts or recesses in their circumferential surfaces, by which the insert pegs, when separated at the predetermined breaking notches, can be locked in the second chamber of the anti-shock sleeves of the plug unit.

* * * * *